US008006416B2

(12) United States Patent
Aydin

(10) Patent No.: US 8,006,416 B2
(45) Date of Patent: Aug. 30, 2011

(54) PANTS PRESSING MACHINE

(76) Inventor: Mehmet Serif Aydin, Brooklyn, NY (US)

( * ) Notice: Subject to any disclaimer, the term of this patent is extended or adjusted under 35 U.S.C. 154(b) by 497 days.

(21) Appl. No.: 12/001,044

(22) Filed: Dec. 10, 2007

(65) Prior Publication Data

US 2009/0145007 A1 Jun. 11, 2009

(51) Int. Cl.
*D06F 71/28* (2006.01)
*D06F 71/34* (2006.01)
*D06F 71/00* (2006.01)

(52) U.S. Cl. ..... 38/16; 223/73

(58) Field of Classification Search ..... 223/72, 223/73, 74; 68/240; 38/14, 16, 17, 36, 26, 38/1 B, 27, 69–71
See application file for complete search history.

(56) References Cited

U.S. PATENT DOCUMENTS

| | | | | | |
|---|---|---|---|---|---|
| 1,105,530 | A | * | 7/1914 | Palmer | 38/16 |
| 1,429,865 | A | * | 9/1922 | Friedman | 38/15 |
| 1,471,676 | A | * | 10/1923 | Arbes | 38/71 |
| 2,050,627 | A | * | 8/1936 | Patterson | 38/20 |
| 2,537,700 | A | * | 1/1951 | Powell et al. | 38/16 |
| 2,719,422 | A | * | 10/1955 | Abraham | 68/240 |
| 2,958,967 | A | * | 11/1960 | Long, Sr. | 38/25 |
| 2,994,978 | A | * | 8/1961 | Skovira | 38/21 |
| 3,133,366 | A | * | 5/1964 | Kienzle | 38/17 |
| 3,203,122 | A | * | 8/1965 | Sweatt | 38/104 |
| 3,305,956 | A | * | 2/1967 | Gottfried | 38/16 |
| 3,430,370 | A | * | 3/1969 | Topliffe | 38/104 |
| 3,491,469 | A | * | 1/1970 | Niehenk | 38/71 |
| 3,512,379 | A | * | 5/1970 | Rasmussen et al. | 68/240 |
| 3,589,042 | A | * | 6/1971 | Airdo | 38/16 |
| 3,593,440 | A | * | 7/1971 | Schlemon | 38/16 |
| 3,719,311 | A | * | 3/1973 | Remiarz | 223/73 |
| 3,835,559 | A | * | 9/1974 | Kotter | 38/21 |
| 4,166,331 | A | * | 9/1979 | Wallace | 38/15 |
| 4,536,978 | A | * | 8/1985 | Cerutti | 38/103 |
| 4,543,739 | A | * | 10/1985 | Zerhoch et al. | 38/15 |
| 5,014,453 | A | * | 5/1991 | Gratsch | 38/36 |
| 5,711,097 | A | * | 1/1998 | Mino | 38/21 |
| 6,038,796 | A | * | 3/2000 | Uchikoshi | 38/20 |
| 7,017,786 | B2 | * | 3/2006 | Ho | 223/73 |

* cited by examiner

*Primary Examiner* — Ismael Izaguirre
(74) *Attorney, Agent, or Firm* — Michael I. Kroll

(57) ABSTRACT

Improved pressing machines for pants, in reference to FIG. 1B an upper portion pressing machine for pants. The framework (11) has a contour shape of the upper portion of a pair of pants, making it easier to drape the upper portion of the pants over the machine for pressing. In reference to FIG. 2B a pressing machine for pressing the inseams and out seams on the legs of a pair of pants. The pressing framework (42) is wider at the rear side and narrower at the opposite end, allowing relatively small and large pants to be pressed. In reference to FIG. 3C the pressing machine is to be used on creased pants. The framework plate (73) has an indention (74). The seams of a pair of pants are aligned with the indention, when the plate (73) is brought down, it will not touch the seams. The pants are left with no impressions or shiny marks. All three pressing machines have steam and vacuum valve connections and are manually operated, by stepping on the foot pedals.

13 Claims, 7 Drawing Sheets

PANTS PRESSING MACHINE

FIELD OF INVENTION

These inventions relate to pants pressing machines, specifically to such pressing machines, which are used on the pants upper portion, pant legs and for creased pants.

BACKGROUND OF THE INVENTION

The puffer machine available for pressing the upper portion of a pair of pants on the market place today is limited on pressing the waist area. The biggest drawback of the puffer machine is its size, it is a small sized puffer machine with a round shape, if a pair of pants are relatively large an operator has to spend more time moving the fabric around and adjusting the pants to fit over the puffer to remove wrinkles, wasting more time just on pressing the upper portion of a pair of pants. The pants still have to be brought to a second station, to complete pressing the waist.

A newer version of the upper puffer pressing machine is electrical and a high cost machine. Since the machine is operated automatically, a switch is pressed and a lot of steam releases from the machine, steam is wasted on pressing just a small area of the pants.

Another great drawback is the upper portion puffer pressing machine also removes the creases from the leg. For an operator it is difficult to spend time searching for the original crease, so as not to make a double crease. Time is wasted looking for the original crease. And still the operator must go to another station to finish pressing the upper portion of the pants. The pocket, back seam and the waist belt area have to be touched up with a hand held flat iron. So it's a two step operation, only to press the upper portion of a pair of pants completely.

Accordingly in order to press the upper portion of a pair of pants correctly, it is conventionally necessary to move to different stations and use several different pressing machines. This as it should be apparent in addition to making it a difficult and time consuming pressing operation, also requires a large space in a pressing shop.

On the market there are pants pressing machines, but there is no equipment that exist that focuses on pressing the inseams and out seams on the legs of a pair of pants. A general pressing machine is used when pressing a pair of pants.

The greatest problem when using a general pressing machine is when the pressing plate is brought down on the legs of the pants. The pressing plate makes contact with the inseams and out seams on the pants. Therefore, impressions of the inseams and out seams are left on the fabric of the pants. Pants are also left with shiny marks along the inseams and out seams on the pant fabric and the fabric is left looking dull.

If a pair of pants are to be pressed without creases, an operator must press the pants with a hand held iron, making it time consuming and costly.

Prior pressing machines that are used for pressing all garments have been around for decades. An operator brings the pressing plate down on the pants 2 times per leg. Therefore the pressing plate is brought down on the pants a total of 4 times for the entire pants.

A new pant pressing machine on the market today has been designed to have a contour crotch shape on one end and a narrow shape on the other end. Allowing small size pants to be pressed but because of the small size it is more time consuming to press larger size pants.

One drawback of the pressing machine is the narrow end, if the bottom of a pair of pants are wide, the pressing plate has to be brought down 2 times per pant leg, making it a total of 4 times the pressing plate has to be brought down to press the entire pants. The finished pressed and creased pants turn out to be more time consuming and costly.

The greatest drawback is when the pressing plates are brought down on the pants, the seams on legs of the pants are left with impression marks and the fabric is left looking shiny.

SUMMARY

It is, therefore an object of the present invention in FIG. 1B, to provide an improved pants pressing machine that can be used for pressing the upper portion of a pair of pants, this machine completes the pressing of the waist area.

It is another object, of the present invention because of its specific designed size and shape feature it will permit relatively small and large pants to be accommodated. Small and large pants will be pressed in the same amount of time.

Accordingly, the present invention due to its manual operation will provide a quick and economic method of pressing and completing the upper portion of the pants.

Yet another object of the present invention due to its manual mechanism, it will be a smaller pressing machine than prior automatic pressing machines, making the present invention a space savor in a small shop.

The operation construction, in particular is designed to connect to a hot heated steam boiler and vacuum duct. Operated manually which can easily be made and which moreover is very competitive from a mere economic stand point.

Accordingly the aim of the present invention in reference to FIG. 2B, is to over come the above mentioned drawbacks.

The present invention has been specifically designed for pressing the inseams and out seams on the legs of a pair of pants. If the pants have a crease, the pressing machine will press the pants but it will not remove the creases. Hence, when pants do not need creases, the pressing of the pants are completed at this one pressing station.

The main object of the present invention is to provide a pants pressing machine that will leave no impression marks of the inseams and out seams on the fabric of the pants.

Another object of the present invention is to provide a pants pressing machine that presses relatively small and large pants. The rear side of the invention is 6 to 10 inches wide, the length is 32 to 37 inches and the hem side is 4 to 6 inches wide. The size and shape of the pressing machine will allow pants of all sizes to be pressed.

Due to the design of the present invention the seams are also pressed. No marks are left on the seams and if pants are lined, the lining will be pressed at the same time.

The object of the present invention in reference to FIG. 3C, is to provide an improved pants pressing machine that will be used for pressing wrinkled and creased pants.

It is the primary object of this invention to provide a pants pressing machine that will not leave the inseams and out seams on a pair of pants with any impression marks or leave the fabric looking shiny. The invention has been designed with the top pressing plate to have an indention 1 to 5½ inches wide and 1 to 3 inches deep. An operator will align the pant leg seams with the indention. When the top pressing plate is brought down, the seams fit directly into the indention. The pressing plate will not hit the seams. The inseams and out seams are left untouched and unmark. Leaving the pants creased and well pressed.

The present invention has been specifically designed to have the top and bottom pressing plates to have a contour crotch shape. The contour crotch shape will make it easy for an operator to line up the pants for pressing. The other end of the top and bottom pressing plates are wide, the present invention may be used in any size situation where some pants are relatively small or relatively large. An operator pressing a large pair of pants will only need to bring the pressing top plate down 1 time per leg. To complete the pressing it will only take bringing the pressing plate down 2 times. Thus an operator will bring the pressing plate down fewer times and spend less time to complete pressing a pair of pants. The crotch side and the hem side are the same size. So if a pair of pants is wider at the leg, the pants will still be pressed bringing the pressing plate down only once on the pants.

Yet another object of the present invention solves the problem of the fabric being left flat and looking faded. The pants pressing machines top plate has an indention, the indention area does not release steam, so the inseams and out seams on the pants are never touched, therefore the fabric of the pants are left fluffy and in its original state.

The present invention provides a pants pressing machine which will make the job of an operator quicker and easier. The invention is a manually operated machine, thus making it an economically lower cost operating pants pressing machine.

BRIEF DESCRIPTION OF SEVERAL VIEWS OF THE INVENTION

In the drawings, closely related figures have the same number but different alphabetic suffixes. Further characteristics and advantages of the present inventions will become more apparent from the following detailed disclosure of the pants pressing machines to be used for pressing the upper portion, the legs and the creases of a pair of pants.

DETAILED DESCRIPTION OF THE PREFERRED EMBODIMENTS

Figure 1A:
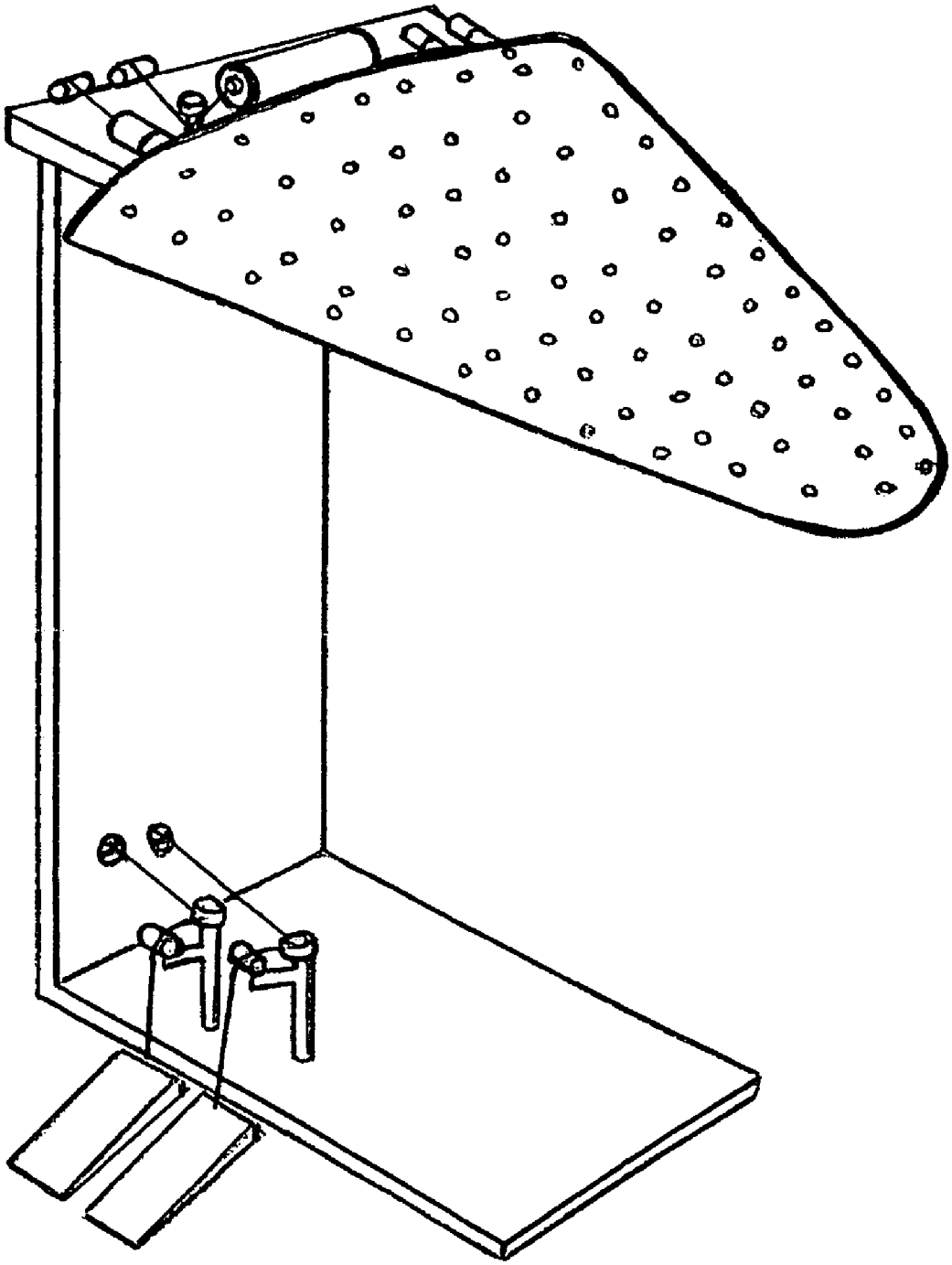
FIG. 1A is a front view of the upper portion pressing machine, illustrating a plurality of tiny steam outlet holes.
Figure 1B:
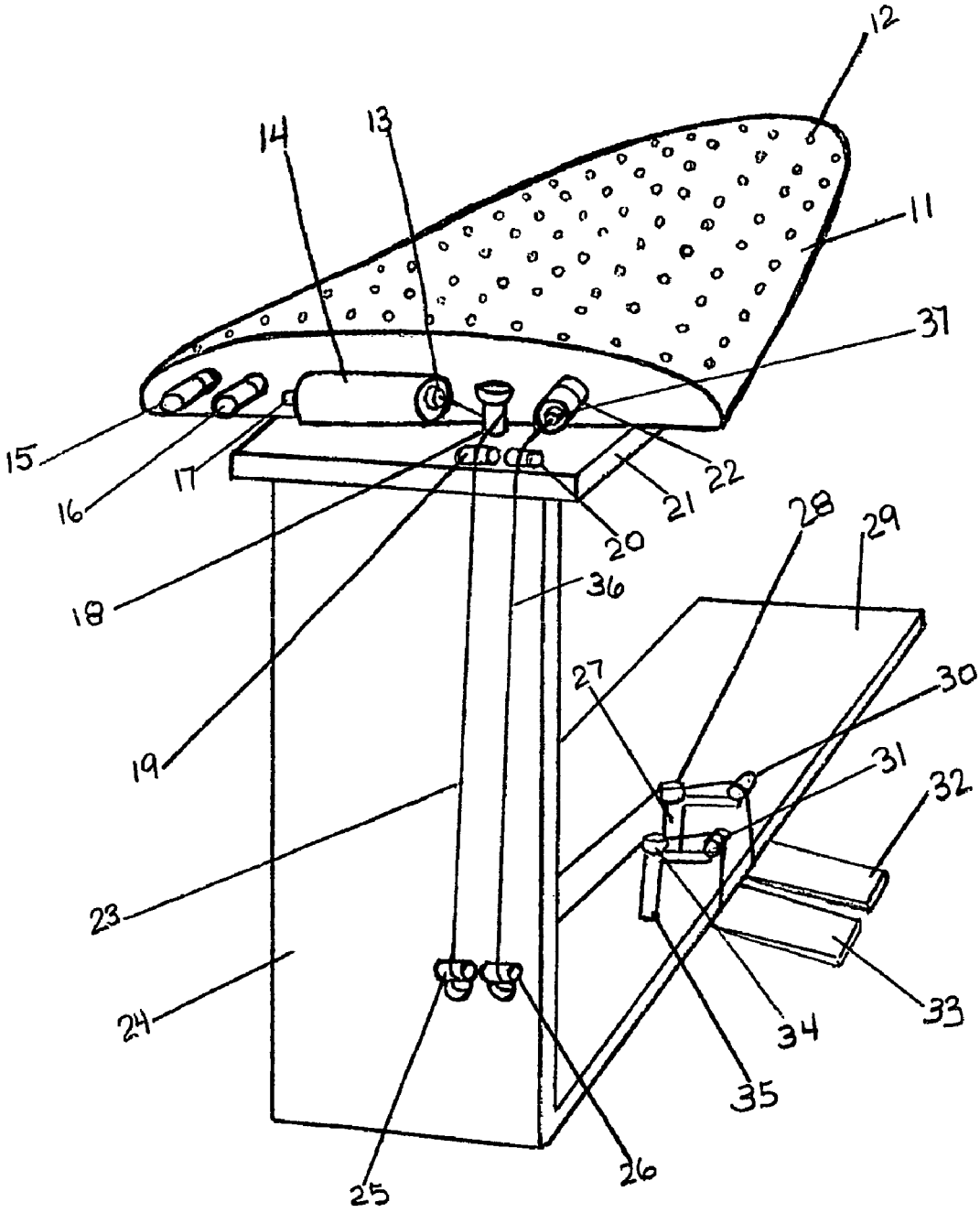
FIG. 1B is a further perspective rear view of the upper portion pressing machine, illustrating in particular the steam, drain and vacuum valve connections.

One embodiment of the pressing machines rear view is illustrated in FIG. 1B. The framework pressing plate 11 has a plurality of tiny steam outlet holes 12. In the preferred embodiment, the rear of the framework pressing plate 11 consists of having several valve connections and two release pins.

Starting from the left side of the embodiment is the first connection, a drain valve 15. The drain valve 15 connects to a drain pipe. The second valve is a boiler valve 16, the boiler valve 16 connects to a boiler. There is also a vacuum valve 14, one end of the vacuum valve 14 has a vacuum valve connection 17 and the other end of the vacuum valve 14 has a pin release 13 that pulls the vacuum valve 14. To the far right of the framework pressing plate 11 is the steam release valve 22 and the steam pin releaser 37.

The framework pressing plate 11 connects to the top support base structure 21. The top support base structure 21 has a wire spool 18. Toward the edge of the top base support structure 21 are two wheels, wheel 19 and wheel 20. The top base supporting structure 21 has a vertical side support base structure 24. The vertical side support base structure 24 towards the far right near the bottom has two wheels, wheel 25 and wheel 26. Directly underneath wheel 25 and wheel 26 are two holes. Metal wired string 23 and metal wired string 36 which will be passing through the two holes. Holding the vertical side supporting base structure 24 is the bottom base support structure 29.

The bottom base support structure 29 has two cylinders. The cylinder 35 to the left has two wheels, wheel 34 and wheel 31. Cylinder 27 to the right has two wheels, wheel 28 and wheel 30. Attached to wheel 31 by a metal wired string 23 is left manual foot pedal 33. Attached to wheel 30 by a metal wired string 36 is the right manually operated foot pedal 32.

The manner of using the upper portion pressing machine is as such one, one places the waist side of a pair of pants draped over the framework pressing plate 11. Due to the specifically designed size and shape of the framework pressing plate 11 relatively small and relatively large pants may be placed easily and pressed. The drain valve 15 is connected to a drain pipe, the boiler valve 16 is connected to the boiler. The vacuum valve 17 is connected to a vacuum.

The upper portion pants pressing machine is operated manually, one steps on the left foot pedal 33. When the left foot pedal 33 is stepped on, it pulls the metal wire string 36. The metal wire string runs through four wheels, wheel 31, wheel 34, wheel 26 and wheel 20. The metal wired string 36 pulls the steam pin release 37 which opens the steam valve 22, which opens a plurality of tiny steam outlets holes 12. Steam leaves the framework pressing plate 11 through the plurality of tiny steam outlet holes 12 through the fabric of the pants.

One then steps on the right foot pedal 32, when the right foot pedal 32 is stepped on, it pulls the metal wire string 23. The metal wired string 23 runs through four wheels, wheel 30, wheel 28, wheel 25 and wheel 19. The metal wired string 23 pulls the vacuum pin release 13, which opens the vacuum valve 14. The vacuum valve 14 pulls the steam through the tiny steam outlet holes 12 and pulls the air through the pants, cooling down the fabric. Thus leaving the upper portion of a pair of pants pressed, if pleats are needed a hand held flat iron may be applied.

Figure 2A:
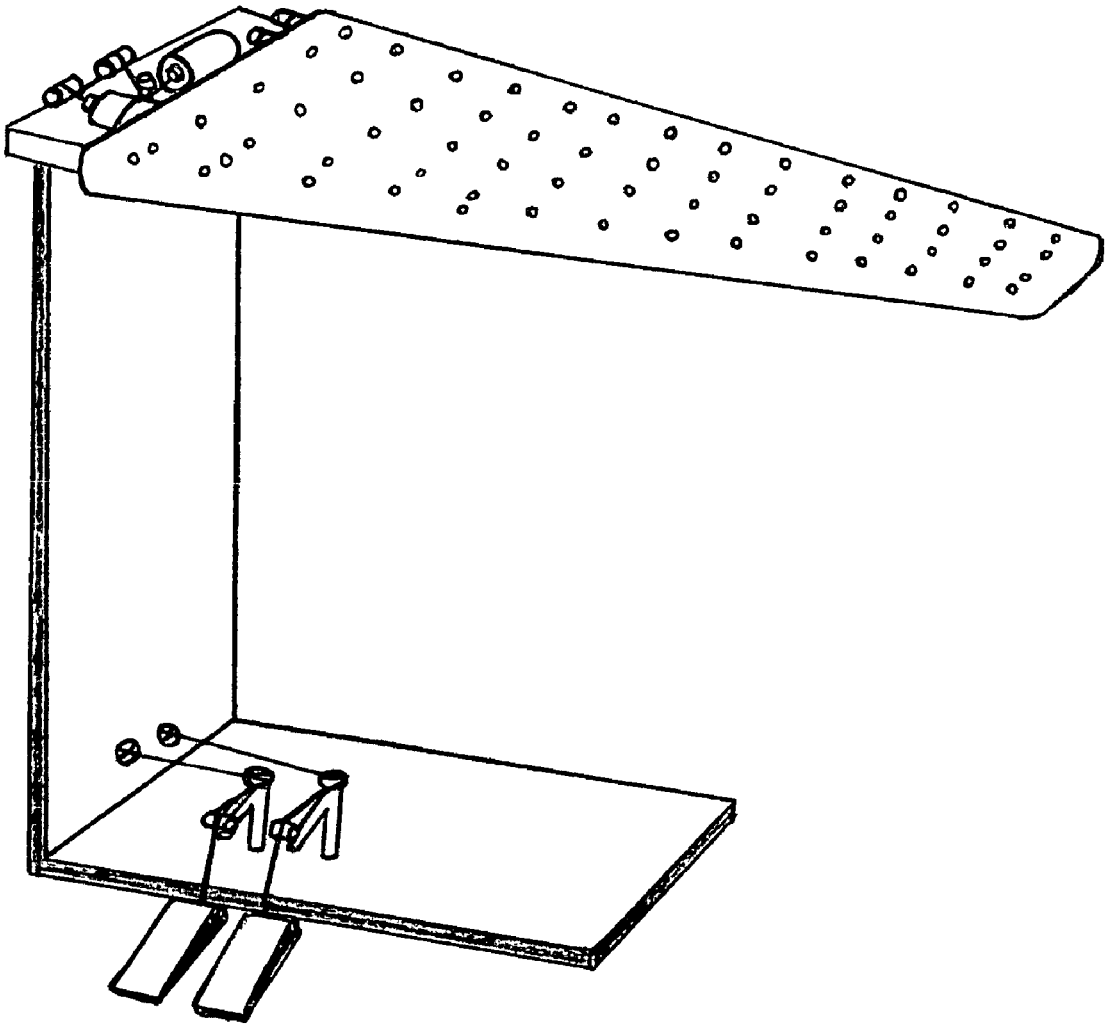
FIG. 2A is a front side view of the pressing machine, illustrating the pants size range means for pressing the legs of a pair of pants.
Figure 2B:
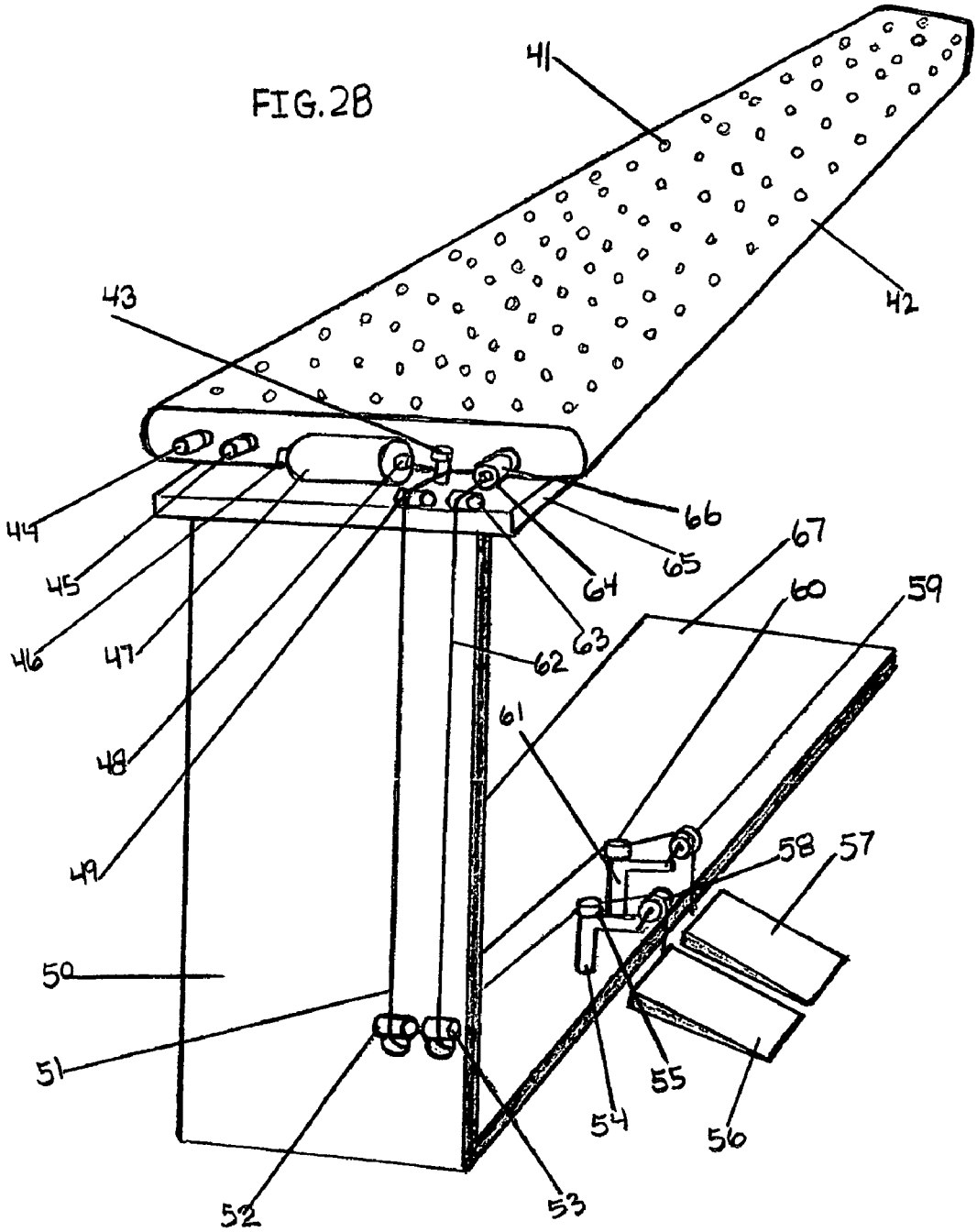
FIG. 2B is a further perspective rear view, illustrating the steam, vacuum connections and the manual foot pedals.

One embodiment of the leg pressing machine is illustrated in FIG. 2B. The long framework pressing plate 42 rear side is wide and narrow on the end of the framework pressing plate 42. The framework pressing plate 42 has a plurality of tiny steam outlet holes 41 all over the framework pressing plate 42. On the rear view of the embodiment of the framework pressing plate 42 are the valve connections and the pin releases.

Starting from the left side of the embodiment is the first connection, a drain valve 44. The drain valve 44 connects to a drain pipe. The second valve is a boiler valve 45, the boiler valve 45 connects to a boiler. There is also a vacuum valve 47, one end of the vacuum valve 47 has a vacuum valve connection 46 and the other end of the vacuum valve 47 has a pin release 48. To the far right of the framework pressing plate 42 is the steam release valve 66 and on the end of the steam release valve 66 is the steam pin releaser 64.

The framework pressing plate 42 connects to the top support base structure 65. The top support base structure 65 has a wire spool 43. Toward the right edge of the top base support structure 65 are two wheels, wheel 49 and wheel 63.

The top bas supporting structure 65 has a vertical side support base structure 50. The vertical side support base structure 50 has two wheels near the bottom on the right side, wheel 52 and wheel 53. Directly underneath wheel 52 and wheel 53 are two holes. Metal wired string 51 and metal wired string 62 both which run through the two holes when pulled. Holding the vertical side supporting base structure 50 is the bottom base support structure 67.

The bottom base support structure 67 has two cylinders. The cylinder 54 to the left has two wheels, wheel 55 and wheel 58. Cylinder 61 to the right has two wheels, wheel 60 and wheel 59. Attached to wheel 58 by a metal wired string 62 is left manual foot pedal 56. Attached to wheel 59 by a metal wired string 51 is right manual foot pedal 57.

The manner of using the leg presser as shown in FIG. 2B is as such one places one leg of a pair of pants through the framework pressing plate 42. Due to the specifically designed size and length of the framework pressing plate 42 relatively small and relatively large pants may be easily draped on the framework pressing plate 42 and pressed.

The drain valve 44 is connected to a drain pipe, the boiler valve 45 is connected to the boiler. The vacuum valve 46 is connected to a vacuum duct. One steps on the left foot pedal 56. When the left foot pedal 56 is stepped on, it pulls the metal wire string 62. The metal wire string 62 runs through four wheels, wheel 58, wheel 55, wheel 53 and wheel 63. The metal wired string 62 pulls the steam pin release 64 which opens the steam valve 66 which opens the plurality of tiny steam outlet holes 41. Steam leaves the framework pressing plate 42 through the plurality of tiny steam outlet holes 41 through the fabric of the pants, removing the wrinkles.

One then steps on the right foot pedal 57, when the right foot pedal 57 is stepped on, it pulls the attached metal wire string 51. The metal wired string 51 runs through four wheels, wheel 59, wheel 60, wheel 52 and wheel 49. The metal wired string 51 pulls the vacuum pin release 48, which opens the vacuum valve 47. The vacuum valve 47 pulls the air through the plurality tiny steam outlet holes 41 and pulls the air through the pant leg, cooling down the fabric, leaving the pant leg pressed. If pants need to be creased a pants creasing pressing machine may be used.

Figure 3A:
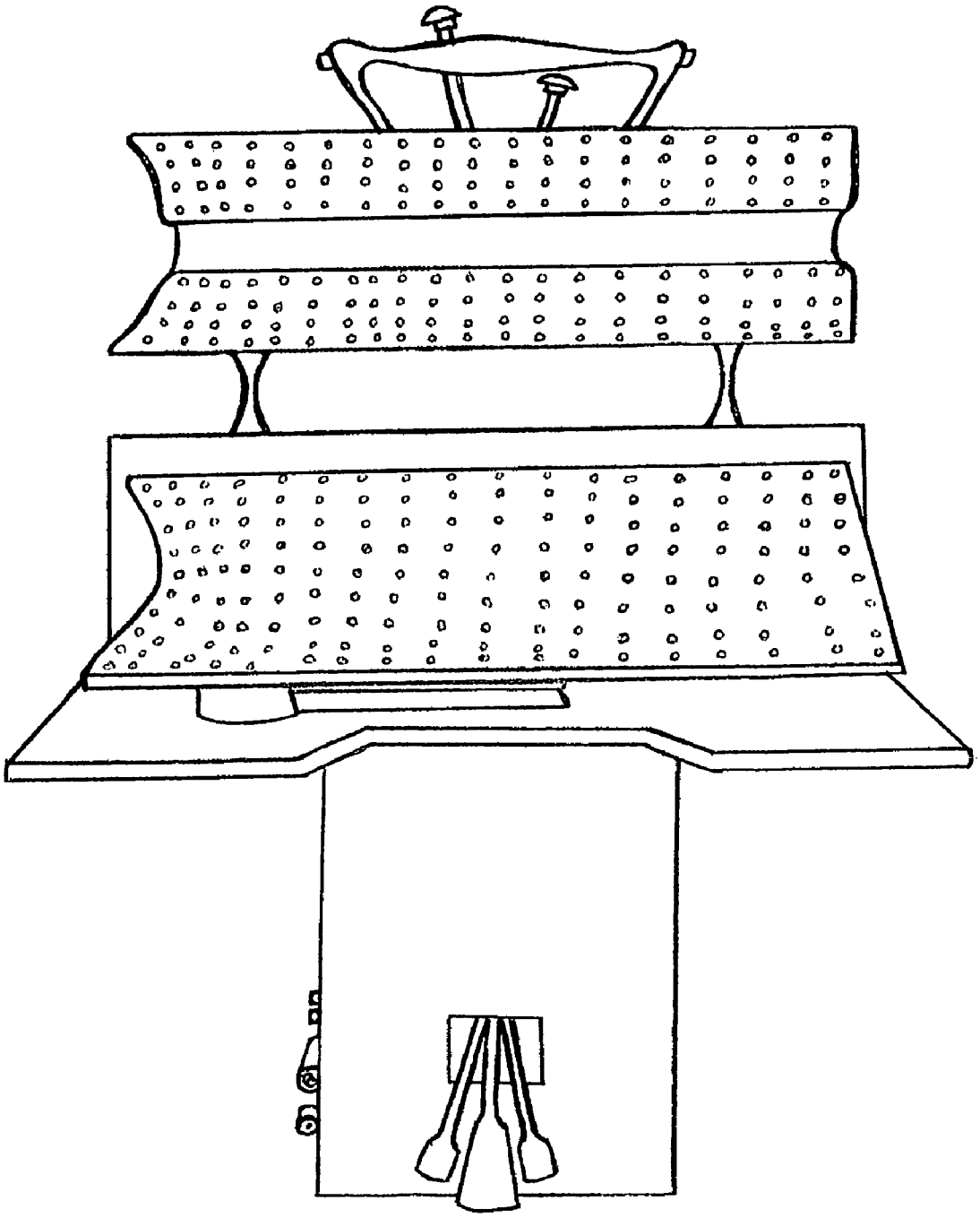
FIG. 3A is a front side view of the creasing pants pressing machine, illustrating the opening and closing means on the pressing machine.
Figure 3B:
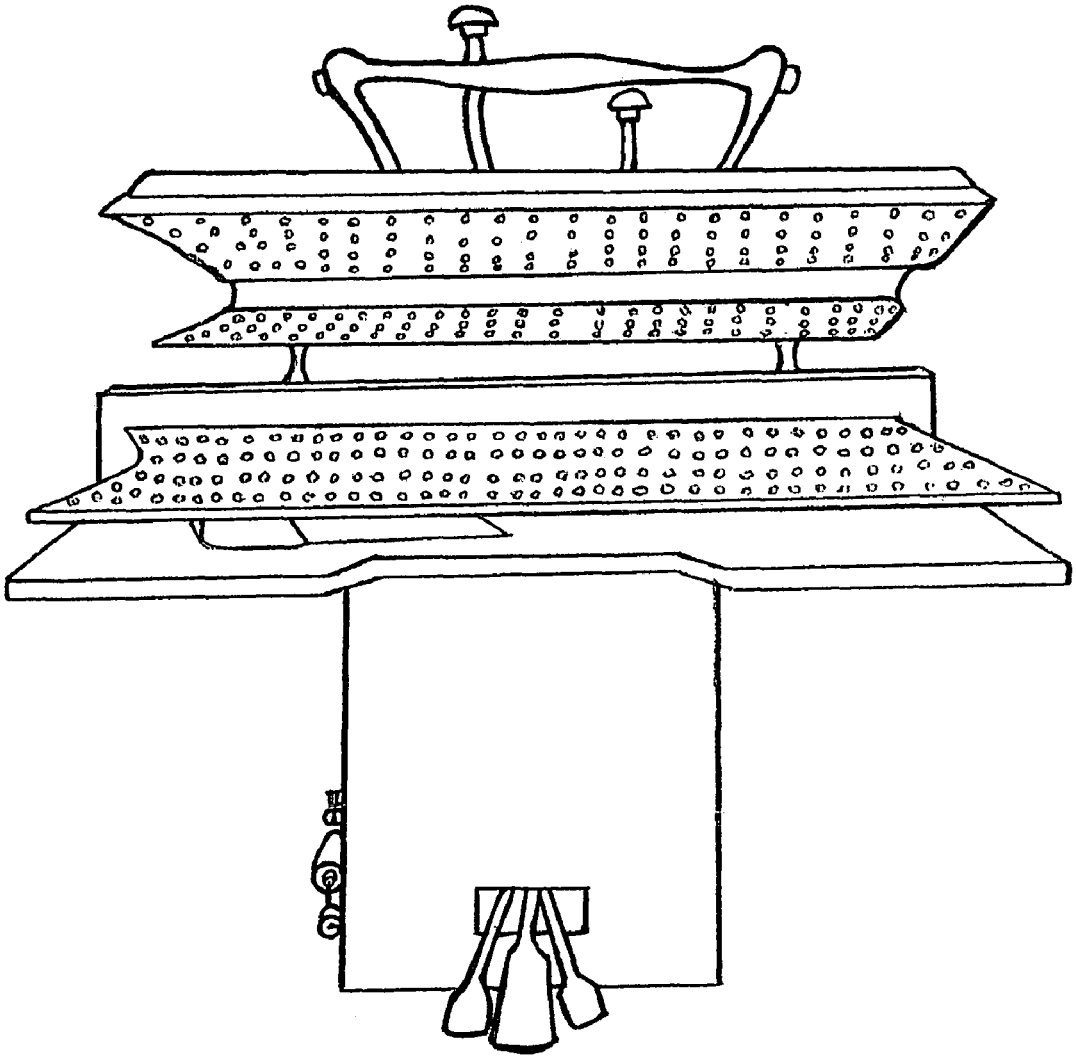
FIG. 3B is a further perspective front view, illustrating the pressing plates and clearly showing the seam indention on the top pressing plate.
Figure 3C:
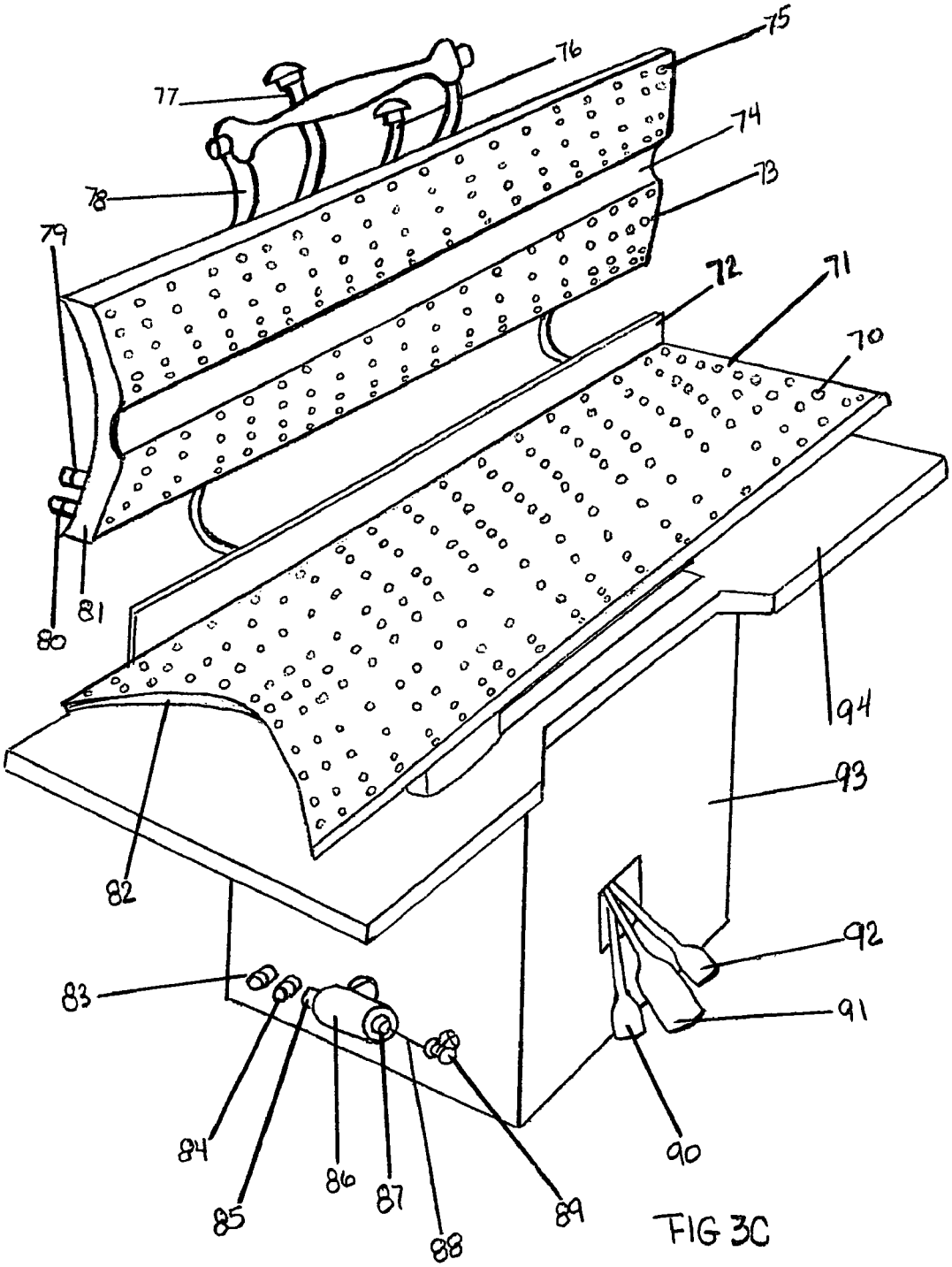
FIG. 3C is a further perspective side rear view, illustrating the steam, drain and vacuum valves connections on the top and bottom pressing plates.

One embodiment of the pants pressing machine a side view is illustrated in FIG. 3C. The pants pressing machine has two framework pressing plates. The top framework pressing plate 73 has a plurality of tiny steam outlet holes 75. The top framework pressing plate also has an indention 74 is the indention 74 is about 1 to 5½ inches wide and 1 to 3 inches deep. On the top framework pressing plate 73 towards the middle is a close handle 78. Next to the close handle 78 are two levers. To the left is the steam release lever 77, to the right is the open lever 76. To the far left on the top framework pressing plate 73 are two valve connections. The top drain valve connection 80 and the top boiler valve connection 79. The left side of the top framework pressing plate 73 has a contour crotch shape 81.

The top framework pressing plate 73 is supported by a table structure 94. On top of the table structure 94 is the bottom framework pressing plate 71. The bottom framework pressing plate 71 also has a plurality of tiny steam outlet holes 70. The far left of the bottom framework pressing plate 71 also has a contour crotch shape 82. Behind the bottom framework pressing plate 71 is a back board 72.

The table structure 94 is supported by the bottom base support structure 93. To the side of the bottom support base structure 93 has three valves used for the bottom framework plate 71. To the far left by the bottom framework pressing plate 71 is the first valve, the drain valve 83. The second valve is the bottom framework pressing plate 71 boiler valve 84. The third valve is the bottom framework pressing plate 71 vacuum valve 86, the vacuum valve 86 has a vacuum valve connection 85. On the other end of the vacuum valve 86 is the vacuum pin release 87. To the far right is a wheel 89, the wheel 89 has a metal wire string 88, that attaches to the vacuum pin release 87. Near the front bottom base support structure 93 are three foot pedals. The left foot pedal 90, the middle and bigger manual foot pedal 91 and the right manual foot pedal 92.

The manner of using the pants pressing machine as shown in FIG. 3C is as such. The pant leg is placed on the bottom framework pressing plate 71. The crotch side of the pant leg is aligned with the contour crotch shape 82. The seam of the pant leg is aligned with the indention 74 of the top framework pressing plate 73.

To close the framework pressing plate 73 an operator must to step on the close pedal 91 and bring down the close handle 78 at the same time. An operator then presses the steam release lever 77. Steam releases through the top framework pressing plate 73, via the plurality of tiny steam outlet holes 75 through the pant leg fabric removing wrinkles. One then steps on the left foot pedal 90. When the left foot pedal 90 is stepped on it pulls the metal wire string 88. The metal wired string 88 runs through wheel 89, which is on the side of the bottom base support structure 93. The metal wired string 88 pulls the vacuum pin release 87, which then opens the vacuum valve 86. The vacuum valve 86 opens the plurality of tiny steam outlet holes 75 on the top framework pressing plate 73 and it also opens the plurality of tiny steam outlet holes 70 on the bottom framework pressing plate 71.

The vacuum 86 pulls the air from the top framework structure 73 and the bottom framework structure 71 through the pant leg and cools the fabric down. One then presses the open lever 76 down to open the pressing machine.

The pant leg is left well pressed and due to the indention 74 on the top framework pressing plate 73. The seams on the pant leg are left unmarked and no impressions are left.

When a different garment is being pressed and extra steam is needed one would step on the right foot pedal 92. When stepping on the right foot pedal 92, steam is released into the bottom framework pressing plate 71 via the plurality tiny steam outlet holes 70. The steam lever 77 is pressed at the same time allowing steam to enter the top framework pressing plate 73 via the tiny steam out let holes 75 into the garment. Leaving a garment fluffy and steam pressed.

What is claimed is:

1. An industrial upper portion of pants pressing steam apparatus to be used on the upper portion of a pelvic area of a pair of pants, wherein the industrial upper portion of pants pressing steam apparatus removes wrinkles, impressions and shine from pants of various sizes, and said industrial upper portion of pants pressing steam apparatus has a triangular shape with rounded corners so that the pelvic area of a pair of pants may be slipped easily over said industrial upper portion of pants pressing steam apparatus, further including a vacuum valve with two openings, wherein a first opening attaches to a vacuum source and a second opening has a pin release, which controls the opening and closing of the vacuum valve allowing air to be received from said industrial upper portion of pants pressing steam apparatus.

2. The industrial upper portion of pants pressing steam apparatus, according to claim 1, wherein said industrial upper portion of pants pressing steam apparatus has a tube connection with a means to connect to an outside drain source.

3. The industrial upper portion of pants pressing steam apparatus, according to claim 2, wherein said industrial upper portion of pants pressing steam apparatuses apparatus has a second tube connection having a connection with a means to connect to a steam source.

4. The industrial upper portion of pants pressing steam apparatus, according to claim 3, wherein said industrial upper portion of pants pressing steam apparatus further comprising a valve having a release pin that controls steam passing via said industrial upper portion of pants pressing steam apparatus.

5. The industrial upper portion of pants pressing steam apparatus, according to claim 4, wherein said industrial upper portion of pants pressing steam apparatus further comprises two elongated foot pedals, a first elongated foot pedal being manually operated to engage a wire string that in turn pulls a pin that in turn opens a steam valve door, allowing steam to pass through said industrial upper portion of pants pressing steam apparatus, a second elongated foot pedal being manually operated to engage a wire string that in turn pulls a pin that in turn opens a vacuum valve door, allowing air to be received from said industrial upper portion of pants pressing steam apparatus.

6. An industrial legs of pants pressing steam apparatus to be used on in/out seams of the legs of a pair of pants, wherein the steam removes wrinkles, impressions and shine from the legs of the pair of pants, further including a vacuum valve with two openings wherein a first opening attaches to a vacuum source and a second opening has a pin release, which controls the opening and closing of said vacuum valve allowing air to be received from said industrial legs of pants pressing steam apparatus.

7. The industrial legs of pants pressing steam apparatus, according to claim 6, wherein said industrial legs of pants pressing steam apparatus has a tube connection with a means to connect to an outside drain source.

8. The industrial legs of pants pressing steam apparatus, according to claim 7, wherein said industrial legs of pants pressing steam apparatus has a second tube connection with a means to connect to a steam source.

9. The industrial legs of pants pressing steam apparatus, according to claim 8, wherein said industrial legs of pants pressing steam apparatus further comprises a valve having a release pin that controls steam passing via said industrial legs of pants pressing steam apparatus.

10. The industrial legs of pants pressing steam apparatus, according to claim 9, wherein said industrial legs of pants pressing steam apparatus further comprises two elongated foot pedals, a first elongated foot pedal being manually operated to engage a wire string that in turn pulls a pin that in turn opens a steam valve door, allowing steam to pass through said industrial legs of pants pressing steam apparatus, a second elongated foot pedal being manually operated to engage a wire string that in turn pulls a pin that in turn opens a vacuum valve door, allowing air to be received from said industrial legs of pants pressing steam apparatus.

11. A method for pressing pants by using three pressing steam apparatuses in sequence comprising:

a. pressing an upper portion of pants using an industrial upper portion of pants pressing steam apparatus;
b. pressing legs of the pants using an industrial legs of pants pressing steam apparatus and
c. forming a crease using an industrial crease-forming steam apparatus; and
d. wherein said industrial upper portion of pants pressing steam apparatus has a triangular shape with rounded corners, said industrial upper portion of pants pressing steam apparatus comprises a vacuum valve with two openings, wherein a first opening attaches to a vacuum source and a second opening has a pin release, which controls the opening and closing of said vacuum valve allowing air to be received from said industrial upper portion of pants pressing steam apparatus, said industrial upper portion of pants pressing steam apparatus further comprising a tube connection with a means to connect to an outside drain source, said industrial upper portion of pants pressing steam apparatus further comprising a second tube connection with a means to connect to a steam source, said industrial upper portion of pants pressing steam apparatus further comprising a valve having a release pin that controls steam passing via said industrial upper portion of pants pressing steam apparatus, said industrial upper portion of pants pressing steam apparatus further comprising two elongated foot pedals, a first elongated foot pedal being manually operated to engage a wire string that in turn pulls a pin that in turn opens a steam valve door, allowing steam to pass through said industrial upper portion of pants pressing steam apparatus, a second elongated foot pedal being manually operated to engage a wire string that in turn pulls a pin that in turn opens a vacuum valve door allowing air to be received from said industrial upper portion of pants pressing steam apparatus.

12. The method according to claim 11, wherein said industrial legs of pants pressing steam apparatus comprises a vacuum valve with two openings, wherein the first opening attaches to a vacuum source and the second opening has a pin release, which controls the opening and closing of said vacuum valve allowing air to be received from said industrial legs of pants pressing steam apparatus, said industrial legs of pants pressing steam apparatus further comprising a tube connection with a means to connect to an outside drain source, said industrial legs of pants pressing steam apparatus further comprising a second tube connection with a means to connect to a steam source, said industrial legs of pants pressing steam apparatus further comprising a valve having a release pin that controls steam passing via said industrial legs of pants pressing steam apparatus, said industrial legs of pants pressing steam apparatus further comprising two elongated foot pedals, a first elongated foot pedal being manually operated to engage a wire string that in turn pulls a pin that in turn opens a steam valve door, allowing steam to pass through said industrial legs of pants pressing steam apparatus, a second elongated foot pedal being manually operated to engage a wire string that in turn pulls a pin that in turn opens a vacuum valve door, allowing air to be received from said industrial legs of pants pressing steam apparatus.

13. The method according to claim 11, wherein said industrial crease-forming steam apparatus comprising a top elongated rectangular plate structure of a rigid material and a bottom elongated rectangular plate structure of a rigid material, said top and bottom elongated rectangular plate structures of approximately equal length, placed adjacently, said top and bottom elongated rectangular plate structures being operated manually, said top elongated rectangular plate structure comprising a long indention, said long indention comprises an indention being approximately 1 to 5½ inches wide and approximately 1 to 3 inches deep, said top elongated rectangular plate structure further comprising means for coupling steam and vacuum valves, said top elongated rectangular plate structure further comprising a close handle, said top and bottom elongated rectangular plate structures both having one crotch-shaped side and one straight side, said top and bottom elongated rectangular plate structures both having a plurality of steam outlet holes, wherein said top elongated rectangular plate structure includes two pushing levers, wherein a first lever of said two pushing levers controls steam release into said top elongated structure via the steam valve, and a second lever of said two pushing levers opens the top elongated rectangular structure, said pressing a crease-forming steam apparatus further comprising three elongated foot pedals, wherein of said three elongated foot pedals, a first elongated foot pedal controls the vacuum suction in said top and bottom elongated rectangular plate structures, a second elongated foot pedal controls the top elongated rectangular plate structure and a third elongated foot pedal operates so that steam may be released into the bottom elongated rectangular plate structure and leave from said bottom elongated rectangular plate structure through the plurality of steam outlet holes into said pants, leaving said pants pressed.

* * * * *